US008998586B2

(12) United States Patent
Muhs

(10) Patent No.: US 8,998,586 B2
(45) Date of Patent: Apr. 7, 2015

(54) SELF PRIMING PUMP ASSEMBLY WITH A DIRECT DRIVE VACUUM PUMP

(76) Inventor: David Muhs, Minnetonka, MN (US)

( * ) Notice: Subject to any disclaimer, the term of this patent is extended or adjusted under 35 U.S.C. 154(b) by 296 days.

(21) Appl. No.: 12/862,601

(22) Filed: Aug. 24, 2010

(65) Prior Publication Data

US 2011/0044827 A1 Feb. 24, 2011

Related U.S. Application Data

(60) Provisional application No. 61/236,447, filed on Aug. 24, 2009.

(51) Int. Cl.

| | |
|---|---|
| ***F04B 23/08*** | (2006.01) |
| ***F04B 23/14*** | (2006.01) |
| ***F04B 17/03*** | (2006.01) |
| ***F04D 9/04*** | (2006.01) |

(52) U.S. Cl.

CPC ..... *F04D 9/041* (2013.01)

(58) Field of Classification Search

USPC ..... 417/68, 69, 85, 199.2, 200, 423.11, 417/201, 202, 203, 435; 416/4; 415/200

See application file for complete search history.

(56) References Cited

U.S. PATENT DOCUMENTS

| | | | | |
|---|---|---|---|---|
| 640,345 | A | 1/1900 | Wiberforce | |
| 1,477,733 | A * | 12/1923 | Van Inwagen | 137/101.27 |
| 1,555,023 | A | 9/1925 | Prokofieff | |
| 1,696,635 | A * | 12/1928 | Jennings | 417/238 |
| 1,735,754 | A | 11/1929 | Hargis | |
| 1,763,595 | A | 6/1930 | Paatsch | |
| 1,832,398 | A * | 11/1931 | Jennings | 417/69 |
| 1,840,257 | A | 1/1932 | Saxe et al. | |
| 1,891,267 | A | 12/1932 | Milkowski | |
| 1,971,774 | A * | 8/1934 | Durdin, Jr. | 417/200 |
| 2,033,980 | A | 3/1936 | Durdin, Jr. | |
| 2,035,781 | A | 3/1936 | Bell | |
| 2,178,994 | A | 11/1939 | Inglis | |

(Continued)

FOREIGN PATENT DOCUMENTS

| | | |
|---|---|---|
| DE | 573029 | 3/1933 |
| DE | 694694 | 8/1940 |

(Continued)

OTHER PUBLICATIONS

W.H. Faragallah: "Liquid ring vacuum pumps and compressors," Gulf Publishing Company, Book Division, 44 pages, 1988.

(Continued)

*Primary Examiner* — Alexander Comley

(74) *Attorney, Agent, or Firm* — Seager Tufte & Wickhem LLC

(57) ABSTRACT

A self-priming pump assembly is disclosed. In an illustrative embodiment, the self-priming pump assembly includes a motor, a main pump having a main pump impeller, a vacuum pump having a vacuum pump impeller, and a drive shaft driven by the motor. The main pump impeller and the vacuum pump impeller may be directly coupled to and driven by the drive shaft, and may rotate about the rotation axis of the drive shaft. In some instances, the vacuum pump impeller is situated between the motor and the main pump impeller, while in other instances, the main pump impeller may be situated between the vacuum pump impeller and the motor. In some cases, bearings may be provided at or near the vacuum pump to help support the vacuum pump relative to the drive shaft.

18 Claims, 2 Drawing Sheets

(56) References Cited

U.S. PATENT DOCUMENTS

Figure 1:
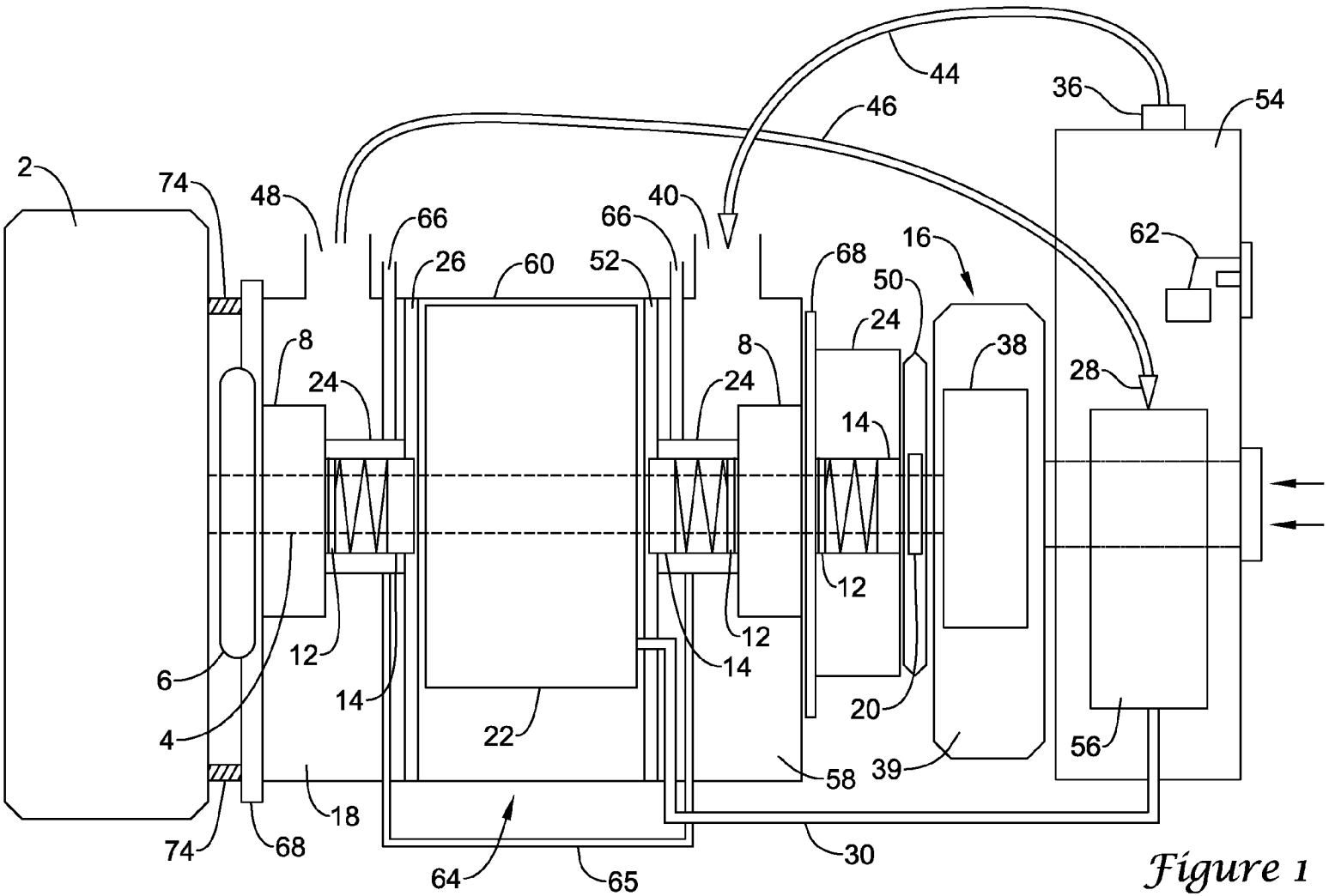

| | | | | |
|---|---|---|---|---|
| 2,194,054 | A | 3/1940 | Peterson | |
| 2,306,988 | A | 12/1942 | Adams | |
| 2,788,745 | A | 4/1957 | Jennings | |
| 3,154,240 | A | 10/1964 | Jennings | |
| 3,272,137 | A | 9/1966 | Maitlen et al. | |
| 3,315,879 | A | 4/1967 | Jennings | |
| 3,394,772 | A | 7/1968 | Abold | |
| 3,518,028 | A | 6/1970 | Minick | |
| 3,522,997 | A | 8/1970 | Rylewski | |
| 3,543,368 | A | 12/1970 | Marlow | |
| 3,584,974 | A * | 6/1971 | Nicastro | 417/202 |
| 3,610,780 | A | 10/1971 | Smith | |
| 3,644,056 | A | 2/1972 | Wiselius | |
| 3,644,061 | A | 2/1972 | McFarlin | |
| 3,712,764 | A | 1/1973 | Shearwood | |
| 3,771,900 | A | 11/1973 | Baehr | |
| 3,867,070 | A | 2/1975 | Sloan | |
| 4,019,680 | A | 4/1977 | Norris | |
| 4,057,368 | A | 11/1977 | Balling | |
| 4,067,663 | A | 1/1978 | Brooks et al. | |
| 4,080,096 | A | 3/1978 | Dawson | |
| 4,116,582 | A | 9/1978 | Sloan | |
| 4,146,353 | A | 3/1979 | Carrouset | |
| 4,183,721 | A | 1/1980 | Peterson | |
| 4,386,886 | A | 6/1983 | Neal | |
| 4,402,648 | A | 9/1983 | Kretschmer | |
| 4,427,336 | A | 1/1984 | Lake | |
| 4,443,158 | A | 4/1984 | Bentele et al. | |
| 4,484,457 | A | 11/1984 | Mugele | |
| 4,498,844 | A | 2/1985 | Bissell et al. | |
| 4,515,180 | A | 5/1985 | Napolitano | |
| 4,601,643 | A | 7/1986 | Seidel | |
| 4,606,704 | A | 8/1986 | Sloan | |
| 4,637,780 | A | 1/1987 | Grayden | |
| 4,648,796 | A | 3/1987 | Maghenzani | |
| 4,687,412 | A | 8/1987 | Chamberlain | |
| 4,708,585 | A | 11/1987 | Fukazawa et al. | |
| 4,737,073 | A | 4/1988 | Grayden | |
| 4,762,465 | A | 8/1988 | Friedrichs | |
| 4,781,529 | A | 11/1988 | Rose | |
| 4,881,614 | A | 11/1989 | Hoshi et al. | |
| 4,902,199 | A | 2/1990 | McDonald et al. | |
| 4,940,402 | A | 7/1990 | McCormick | |
| 4,946,349 | A * | 8/1990 | Manabe et al. | 417/68 |
| 4,973,993 | A | 11/1990 | Allen | |
| 4,981,413 | A | 1/1991 | Elonen et al. | |
| 4,989,572 | A | 2/1991 | Giacomazzi et al. | |
| 4,992,028 | A | 2/1991 | Schoenwald et al. | |
| 5,078,169 | A | 1/1992 | Scheurenbrand et al. | |
| 5,078,573 | A | 1/1992 | Peroaho et al. | |
| 5,114,312 | A | 5/1992 | Stanislao | |
| 5,203,677 | A | 4/1993 | Lix et al. | |
| 5,242,268 | A | 9/1993 | Fukazawa et al. | |
| 5,328,274 | A | 7/1994 | Wallace et al. | |
| 5,380,042 | A | 1/1995 | Hively et al. | |
| 5,382,132 | A | 1/1995 | Mendel | |
| 5,464,329 | A | 11/1995 | Senoo et al. | |
| 5,487,644 | A | 1/1996 | Ishigaki et al. | |
| 5,489,195 | A | 2/1996 | Domagalla et al. | |
| 5,536,147 | A | 7/1996 | Lang | |
| 5,542,822 | A | 8/1996 | Stretz et al. | |
| 5,580,222 | A | 12/1996 | Bornemann | |
| 5,588,806 | A | 12/1996 | Trimborn et al. | |
| 5,641,271 | A | 6/1997 | Forrester et al. | |
| 5,660,533 | A * | 8/1997 | Cartwright | 417/435 |
| 5,673,940 | A | 10/1997 | Gaisford et al. | |
| 5,797,377 | A | 8/1998 | Fischerkeller | |
| 5,797,724 | A | 8/1998 | Liu et al. | |
| 5,800,146 | A | 9/1998 | Junemann et al. | |
| 5,807,067 | A | 9/1998 | Burdick | |
| 5,846,420 | A | 12/1998 | Bolton et al. | |
| 5,944,216 | A | 8/1999 | Inaoka et al. | |
| 5,960,981 | A | 10/1999 | Dodson et al. | |
| 5,997,242 | A | 12/1999 | Hecker et al. | |
| 6,152,689 | A | 11/2000 | Yokota et al. | |
| 6,158,959 | A | 12/2000 | Arbeus | |
| 6,315,524 | B1 * | 11/2001 | Muhs et al. | 417/199.2 |
| 6,409,478 | B1 | 6/2002 | Carnes et al. | |
| 6,585,492 | B2 * | 7/2003 | Muhs et al. | 417/68 |
| 6,585,493 | B2 * | 7/2003 | Sutton | 417/69 |
| 6,607,351 | B1 * | 8/2003 | Hablanian | 415/90 |
| 6,692,234 | B2 | 2/2004 | Muhs | |
| 6,705,840 | B1 | 3/2004 | Hauser et al. | |
| 7,044,716 | B2 | 5/2006 | Fabry | |
| 7,455,504 | B2 * | 11/2008 | Hill et al. | 416/179 |
| 2006/0110261 | A1 | 5/2006 | Muhs | |

FOREIGN PATENT DOCUMENTS

| | | |
|---|---|---|
| DE | 2440905 | 3/1976 |
| DE | 2913960 | 10/1979 |
| DE | 3040160 | 6/1982 |
| DE | 3840819 | 6/1990 |
| EP | 0333045 | 9/1989 |
| EP | 0556527 | 8/1993 |
| EP | 0606154 | 7/1994 |
| EP | 0701062 | 3/1996 |
| FR | 1468696 | 2/1967 |
| FR | 2748526 | 11/1997 |
| GB | 1488439 | 10/1977 |
| GB | 1542483 | 3/1979 |
| GB | 2181487 | 4/1987 |
| GB | 2303178 | 2/1997 |
| JP | 63186985 | 8/1988 |
| SU | 779643 | 11/1980 |
| WO | 9301396 | 1/1993 |
| WO | 9816403 | 4/1998 |

OTHER PUBLICATIONS

Godwin Pumps, Dri-Prime Contractors Pumps brochure, 4 pages, prior to Mar. 22, 1999.
Hidrostal, Sectional Drawings Q-Hydralic, 1 page, Sep. 19, 1994.
Neyrtec—Alstrhom ATlantique: "Hydro Vakuumpumpen und—verdichter der Reihen NS-CNS,"S.A. IMP. Boissy & COL0MB., Grenoble XP002253993, 4 pages, Jul. 1979. (No English translation. This article is relevant because it was cited on the Supplementary European Search Report).
Parma Pompe, "Catologo Generale," 8 pages, prior to Mar. 22, 1998.
Parma Pompe, "Omega.S Brochure," 8 pages, prior to Mar. 22, 1999.
"Principles of Operation", p. 2, prior to Mar. 22, 1999.
"Pumping of Liquids and Gases," pp. 6-24, prior to Mar. 22, 1999.
Selwood, "Seltorque 100C & 150C," 2 pages, prior to Mar. 22, 1998.
Selwood, "150SA," 2 pages, prior to Mar. 22, 1998.
"SLD Pumps 091 410 4611," SLD Pumps Ltd., 25 pages, prior to Mar. 22, 1998.
SPP Pumps Ltd., "Hydrostream Horizontal Split Case Pumps," 6 pages, prior to Mar. 22, 1999.
SPP Pumps Ltd., "Literature Folio," 96 pages, prior to Mar. 22, 1999.
Thompson Pump & Manufacturing Co., Inc., "Dewatering Diaphragm Trash," 30 pages, prior to Mar. 22, 1998.
www.spx.com/enjohnson-pump/pd-mp-self-priming-single-stage-centrifugal-pump-combiprime/, CombiPrime H& V, Self-Priming Single Stage Centrifugal Pumps, 1 page, printed Jan. 16, 2013.
SPX, Johnson Pump, "CombiPrime H Horizontal Self Priming Centrifugal Pump," Instruction Manual, 84 pages, issued Nov. 2011.
SPX, Johnson Pump, "CombiPrime V Vertical Self-Priming Centrifugal Pump," Instruction Manual, 86 pages, Copyright 2000, 2008.

* cited by examiner

The tests were done the same day with only changing the vacuum pump impellers.
The tests were repeated four times for each impeller and the average used.
The liquid used was clear water at 50°F with a roto meter to measure flow rate of the Vacuum pump discharge at the discharge with 12" of hose and no inlet hose.

SELF PRIMING PUMP ASSEMBLY WITH A DIRECT DRIVE VACUUM PUMP

PRIORITY

This application claims priority under 35 U.S.C. §119 to U.S. Provisional Patent Application No. 61/236,447, filed Aug. 24, 2009, and entitled "SELF PRIMING PUMP ASSEMBLY WITH A DIRECT DRIVE VACUUM PUMP", which is incorporated herein by reference.

TECHNICAL FIELD

This disclosure relates to pumps, and more particularly, to self priming pump assemblies that include a main pump, and a vacuum pump to help prime the main pump.

SUMMARY

This disclosure relates to pumps, and more particularly, to self priming pump assemblies that include a main pump, and a vacuum pump to help prime the main pump.

In one illustrative embodiment, a self priming pump assembly includes a main pump inlet and a main pump outlet. During normal pump operation, the self priming main pump assembly pumps fluid from the main pump inlet to the main pump outlet. The main pump inlet may be fluidly coupled to a priming tank. The priming tank may provide fluid to a pump impeller of the main pump. A vacuum pump may be fluidly coupled to the priming tank. The pressure drop created by the vacuum pump suction may help pull fluid through the main pump inlet and into the priming tank. This fluid then functions to prime the main pump. Sometimes, a float or the like may be provided in the priming tank to regulate the level of water in the priming tank.

A motor may be provided to drive the pump impeller of the main pump. The impeller may be situated in a volute of the main pump. A drive shaft may be coupled between the motor and the pump impeller. The drive shaft may transfer rotational force produced by the motor to the pump impeller of the main pump. In some cases, the vacuum pump may be situated between the motor and the main pump impeller, and may be directly driven by the drive shaft. In some instances, the vacuum pump may include an vacuum pump impeller situated within a vacuum pump housing, and the vacuum pump impeller may rotate about a rotation axis. The drive shaft may pass through an aperture in the vacuum pump impeller and along the rotation axis of the vacuum pump impeller such that rotation of the drive shaft causes a corresponding rotation of the vacuum pump impeller. It is contemplated that the vacuum pump may be any suitable pressure producing/reducing source, such as an oil lubricated vacuum pump, a liquid ring vacuum pump, a scroll type compressor, or any other type of pressure producing/reducing source as desired.

BRIEF DESCRIPTION

Figure 2:
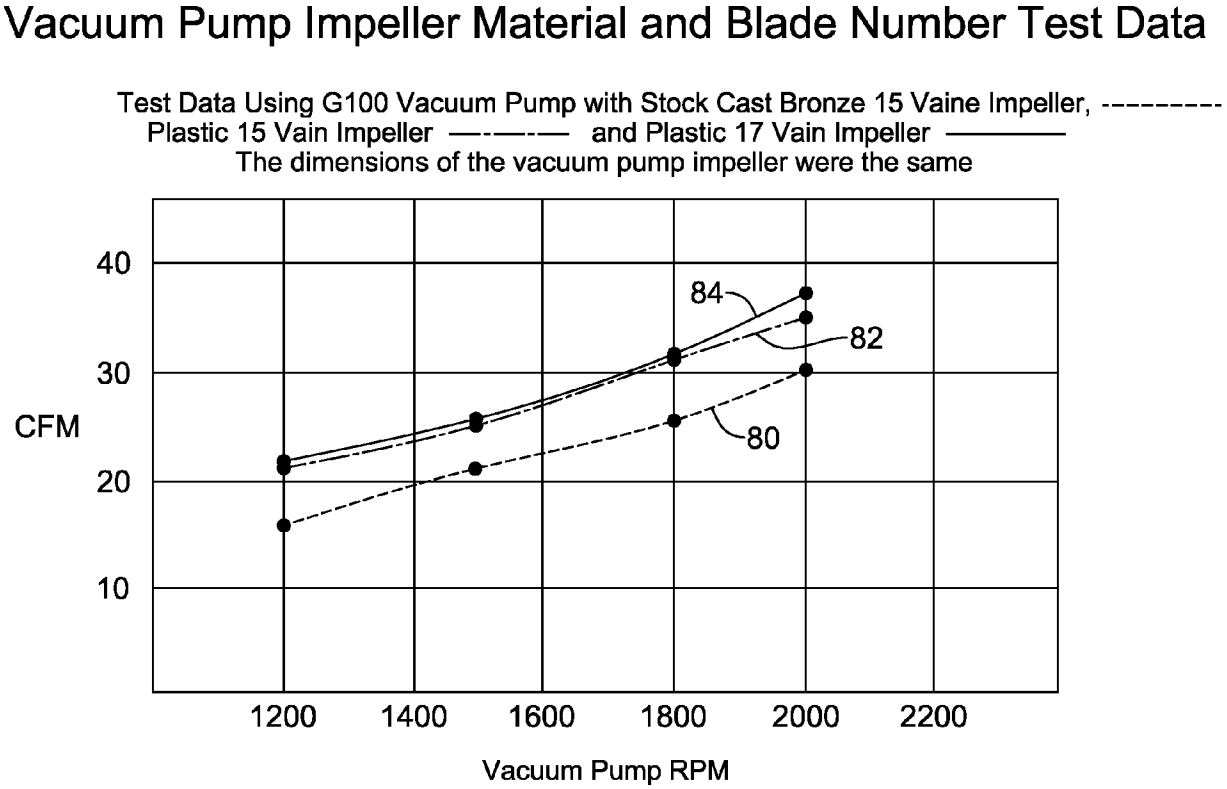

FIG. 1 is a schematic partial cross-sectional side view of an illustrative self-priming pump assembly; and FIG. 2 is a graph showing test data for the efficiency of a vacuum pump with several different pump impeller characteristics.

DESCRIPTION

The following description should be read with reference to the attached Figures. The attached Figures and are not intended to limit the scope of the invention. The use and placement of the various illustrative components is only illustrative.

FIG. 1 is a schematic partial cross-sectional side view of an illustrative self-priming pump assembly. In the illustrative embodiment of FIG. 1, a motor 2 is provided to drive a main pump impeller 38 of the self priming pump assembly. It is contemplated that the motor 2 may be a gas, diesel, electric or any other suitable motor or drive mechanism, as desired. In some cases, the motor is less than 500 horsepower, less than 100 horsepower, less than 50 horsepower, less than 25 horsepower, less than 10 horsepower, or any other suitable horsepower, as desired.

The pump impeller 38 of the main pump 16 may be situated in a volute, schematically shown at 39. A drive shaft 4 (shown in dashed lines) may be coupled between the motor 2 and the pump impeller 38 of the main pump 16, and in some cases, may be coupled to a flywheel 6. The drive shaft 4 may transfer rotational force produced by the motor 2 to the pump impeller 38. The drive shaft 4 may be made from a single piece of material (e.g. metal), or may be made from two or more components that are secured together to form a common drive shaft 4.

In some cases, a vacuum pump 64 may be situated between the motor 2 and the pump impeller 38, and may be directly driven by the drive shaft 4. In the illustrative embodiment, the vacuum pump 64 includes a vacuum pump impeller 22 that is situated within a housing 60, and the vacuum pump impeller 22 may rotate about a rotation axis (generally along the axis of the drive shaft 4). In the illustrative embodiment, the drive shaft 4 passes through a central aperture of the vacuum pump impeller 22, and along the rotation axis of the vacuum pump impeller 22, and is connected to the vacuum pump impeller 22 such that rotation of the drive shaft 4 causes a corresponding rotation of the vacuum pump impeller 22 of the vacuum pump 64. In some cases, a sheer pin or the like may be provided to disconnect the vacuum pump impeller 22 from the drive shaft 4 if/when the vacuum pump impeller 22 of the vacuum pump 64 seizes or otherwise becomes locked or stuck. It is contemplated that the vacuum pump 64 may be any suitable pressure producing/reducing source, such as an oil lubricated vacuum pump, a liquid ring vacuum pump, a scroll type compressor, or any other type of pressure producing/reducing source as desired. In some cases, the housing (e.g. volute 39) of main pump 16 is coupled to the vacuum pump housing 60, and the vacuum pump housing 60 is coupled to the housing of the motor 2.

As can be seen, in the illustrative example, the same drive shaft 4 drives the centrifugal or main pump impeller 38 of the main pump 16, as well as the vacuum pump impeller 22 of the vacuum pump 64. In this example, the vacuum pump 64 may run at the same Revolutions Per Minute (RPM) as the motor 2 to meet the power and speed requirements of the main pump 16, which is typically in the 1000 to 2400 RPM range or somewhere in-between. This RPM is, however, dependent on the pump size and application.

The use of a common drive shaft 4 may help reduce the number of parts needed. In some cases, only one set of bearings 8 are used on either (or both) ends of the vacuum pump 64, and may be positioned in end castings 18 and/or 58. In some cases, one end of the shaft 4 may be coupled to, or be part of, the engine drive coupling 6. In some cases, the vacuum pump 64 may include seal housing(s) 24 (sometimes oil filled seal housing) that is attached to the vacuum pump end casting 18 and/or 58, either directly or with a mounting plate 68, which in some cases may be used to attach, for example, the vacuum pump end casing 18 to engine drive mounting bolt holes 74. In some cases, an adaptor plate (not shown) may be used to attach the end casting 18 to the engine mounting holes 74, if desired. In some cases, the seal housing (s) 24 may include an oil seal 12 and a rotating shaft seal 14, if desired. In some cases, the oil seal 12 and/or the rotating shaft seal 14 may be provide in an oil bath cavity that is fluidly connected to an external oil reservoir via pathways 66, and to other oil seals 12 and/or the rotating shaft seals 14 via pathway 65, if desired.

In the illustrative example shown in FIG. 1, the main pump impeller 38 is attached to or near the other end of the shaft 4 as shown, sometimes using the bearings 8 of the vacuum pump 64 for support. In some cases, bearings may be provided for the pump impeller 38 of the main pump 16 as well as the vacuum pump 64, but this is not required. In some instances, a seal plate 50 may be attached to the seal housing or part of the seal housing 24 as well as the volute 39 of the main pump 16, if desired. The seal plate 50 may include a stationary shaft seal 20.

In the illustrative embodiment of FIG. 1, an air/water separator tank or priming tank 54 may be provided on the suction side of the main pump 16. In some cases, such as when the vacuum pump 64 is a liquid ring vacuum pump, the priming tank 54 may have an internal separator tank 56 that is fluidly isolated from the priming tank 54 but thermally coupled to the fluid in the priming tank 54. The internal tank 56 may be used to separate the air and water discharge 48 from a liquid ring vacuum pump 64 through a hose 46 into inlet 28. In another example, a water jacket surrounding a discharge check valve for main pump 16 (not shown) and/or an external tank (not shown) may be used to separate the air and water discharge 48 from a liquid ring vacuum pump 64 and/or absorb heat generated from the energy put into the liquid within the liquid ring vacuum pump 64.

In some cases, a float control system 62 may be used to control the vacuum level needed to prime the main pump 16 at varying priming depths, wellpoint systems and/or other suction devices connected to the pump. The float control system 62 may have the ability to allow enough air flow into the priming tank 54 so that the liquid level in the tank 54 never reached the air outlet 36 which leads to the vacuum pump 64 via hose 44. This may allow for little or no restrictions caused by valves regulating the air flow from the priming tank 54 to the vacuum pump inlet 40 that sometimes can reduce the air flow to less that the rated capacity of the vacuum pump 64. The water needed for a liquid ring vacuum pump 64 may be supplied by a fresh water source, or may be re-circulated in a closed water system, and may include internal tank 56 that allows heat to be transferred from the water of the liquid ring vacuum pump 64 to the material being pumped by the main pump 16. Oil lubricated vacuum pumps may have a closed oil reservoir with an air/oil separator that helps reduce or eliminate discharge of oil in the air discharge of the vacuum pump.

In some cases, the vacuum pump 64 may include an inlet port plate 52 and an outlet port plate 26. The casting 58 may have a water feed hole through port plate 52 that is in fluid communication with hose 30, which may be fluidly coupled to the internal tank 56. Port plate 52 may also have inlets for air. Likewise, casting 18 may have an outlet port plate 26, which may be substantially the same size as port plate 52, but with different size openings for the air outlet and no water inlet. While an inlet port plate 52 and outlet port plate 26 are shown in FIG. 1 on either side of the vacuum pump impeller 22, it is contemplated that the vacuum pump 64 may have only one port plate on one side of the vacuum pump impeller 22, with ports for the inlet of air and the outlet of air. In such a configuration, the vacuum pump inlet 40 and the air/water outlet 48 would most likely be located on the same side (e.g. right side in FIG. 1) of the vacuum pump impeller 22. In any event, the port opening sizes can be changed to give either maximum CFM or maximum inches of vacuum, or a design the provided the best overall balance in CFM and vacuum level. Seal housings 24 on the vacuum pump may contain liquid to lubricate the seals in the chance that there was no water in the internal tank 56.

In some cases, castings 18 and 58 may be the same, and could include a bearing location, a shaft seal and a port plate location on each side of the vacuum pump impeller 22. The vacuum pump impeller 22 can be housed in the housing 60. For a liquid ring vacuum pump, the housing 60 may be an eccentric as shown located off center of the vacuum pump impeller 22. Changing the width of the vacuum pump impeller 22 or its diameter could change the vacuum pump capacity and/or operating characteristics, as desired.

In some cases, the castings 18 and 58 may be metal, plastic, ceramic or any other suitable material. Likewise, the vacuum pump impeller 22 of the vacuum pump 64 may be metal, plastic, ceramic or any other suitable material. In some cases, it has been found that using a smoother impeller surface may dramatically increase the performance of the vacuum pump 64, such as by 30% or more, relative to an impeller with a rougher surface. FIG. 2 is a graph showing test data for the efficiency of a vacuum pump with several different pump impeller characteristics. More specifically, FIG. 2 shows the measured cubic feet per minute (CFM) that was pumped by a liquid ring vacuum pump over various Revolutions Per Minute (RPM) of the vacuum pump, for three different impellers. The first impeller was a stock cast bronze fifteen vane impeller having an estimated average roughness Sa of about 500 microns (ISO/DIS 25178-2, ASME B46.1). The roughness was due to the size of the sand particles used in the casting process of the impeller. The blades of this impeller also had a small draft, which allows the casting to be more easily removed from the mold. The data for this impeller is shown at 80. The second impeller was a plastic fifteen vane impeller having an estimated average roughness Sa of about 30 microns (ISO/DIS 25178-2, ASME B46.1). The blades of this impeller had very little if any draft. The data for this impeller is shown at 82. The third impeller was a plastic seventeen vane impeller having an estimated average roughness Sa of about 30 microns (ISO/DIS 25178-2, ASME B46.1). The blades of this impeller had very little if any draft. The data for this impeller is shown at 84. As can be seen, the smooth impellers 82 and 84 experienced about a 30 percent increase in CFM over the rougher impeller 80 over a range of RPM values. This relatively large increase in efficiency was a surprising result to the inventor of the present application. It is believed that providing an impeller with an average surface roughness Sa of less than 500 microns, less than 250 microns, less than 100 microns, less than 50 microns, less than 30 microns, or less, may provide a substantial increase in efficiency to the vacuum pump.

The vacuum pump impeller 22 of the vacuum pump 64 may be made from metal (e.g. aluminum, stainless steel, bronze, etc.), ceramic, plastic or any other suitable material. In some cases, the vacuum pump impeller 22 may be made from Delrin, thermo set plastic, polyester, fiberglass, fiberglass filled with nylon, nylon, polyethylene, PVC, polycarbonate, or any other suitable material as desired. In some cases, the average surface roughness Sa of the impeller is less than 250 microns, less than 125 microns, less than 50 microns, less than 30 microns, or any other suitable surface roughness.

In some cases, the castings 18 and 58, port plates 26 and 52, and/or other components of the vacuum pump 64 (see FIG. 1)

may be made from plastic, metal, ceramic, or any other suitable material. It is believed that by making the air passageways in the castings 18 and 58 to have an average surface roughness that is less than 250 microns, less than 125 microns, less than 50 microns, or less than 30 microns, the efficiency of the vacuum pump 64 may even be further improved. There may also be considerable cost savings using a molded plastic or composite part compared to metal castings that typically have higher costs and often require more machining.

The cost savings of such a design could be realized in pumps as small as 1 inch output lines, 2 inch output lines or larger. This cost savings may allow affordable pumps in, for example, the 2 inch through 4 inch pumps, 4 inch through 12 inch pumps, or larger, while having the advantage of dry priming using a vacuum system. Cost savings could help reduce the cost of the pump to less than half of the dry prime pumps in this size range. Moreover, having dry prime vacuum systems on small pumps may save considerably on fuel costs as replacements of larger pumps with much larger engines, thereby reducing green house gases and fuel costs.

In many current designs of pumps in smaller sizes (e.g. 4 inch or less), vacuum priming can add more to the cost of the pump package than the main pump cost, sometimes as much as 4 times the main pump cost. Self-priming pumps using a wet prime design, where the pump case is filled with the fluid, often do not have bearing housings. This can put the impeller radial and thrust loads onto the engine, which can reduce engine bearing life. The use of one drive shaft to drive both the vacuum source and main pump can increase the reliability of the pump system, with fewer parts, relative to other vacuum priming systems. The use of one drive shaft can be used in smaller and larger pumps, as desired.

An alternate way of using a common shaft to drive both the main pump 16 and vacuum pump 64 is to mount the main pump 16 next to the motor 2, and use a double entry main impeller 38 with the vacuum pump 64 mounted on the other side (right side in FIG. 1) of the main pump 16 from the motor 2. In some cases, it is contemplated that the volute 39 of the main pump 16 may be mounted in the air/water separator tank 54 or the like, sometimes with an internal tank 56 that would not disrupt flow to the main impeller 38. In some cases, the vacuum pump 64 may also be situated in the priming tank 54, if desired. Such configurations may reduce the number of components, as well as size, of the overall pump assembly.

What is claimed is:

1. A self-priming pump assembly, comprising:

a motor having a motor housing;

a main pump having a main pump impeller;

a drive shaft having a rotation axis, the drive shaft extending between the motor and the main pump impeller, the drive shaft directly driving the main pump impeller from the motor;

a vacuum pump, separate from the main pump, having a vacuum pump impeller rotatably disposed in a vacuum pump housing along a rotation axis, the vacuum pump impeller situated between the main pump and the motor, and the vacuum pump impeller being coupled to the drive shaft and rotating about the rotation axis of the drive shaft;

a first bearing supporting the drive shaft between the motor and the vacuum pump impeller;

a second bearing supporting the drive shaft between the vacuum pump impeller and the main pump impeller;

a first seal physically engaging and providing a seal about the drive shaft, the first seal positioned adjacent a first side of the vacuum pump impeller;

a first seal chamber holding a liquid bath to lubricate the first seal;

a second seal physically engaging and providing a seal about the drive shaft, the second seal positioned adjacent a second side of the vacuum pump impeller opposite the first side;

a second seal chamber holding a liquid bath to lubricate the second seal;

a third seal physically engaging and providing a seal about the drive shaft, the third seal positioned between the main pump impeller and the vacuum pump; and a third seal chamber holding a liquid bath to lubricate the third seal.

2. The self-priming pump assembly of claim 1, wherein the main pump has a main pump housing, the main pump housing is coupled to the vacuum pump housing, and the vacuum pump housing is directly coupled to the motor housing.

3. The self-priming pump assembly of claim 1, wherein the main pump has a main pump inlet and a main pump outlet.

4. The self-priming pump assembly of claim 3, further comprising a priming tank in fluid communication with the main pump inlet.

5. The self-priming pump assembly of claim 4, wherein the vacuum pump has a vacuum pump inlet and a vacuum pump outlet, wherein the vacuum pump inlet is in fluid communication with the priming tank.

6. The self-priming pump assembly of claim 5, further comprising a separator tank in thermal communication with a fluid being pumped by the main pump, the vacuum pump outlet in fluid communication with the separator tank.

7. The self-priming pump assembly of claim 1, wherein the vacuum pump impeller has an average surface roughness of about 100 microns or less.

8. The self-priming pump assembly of claim 1, wherein the vacuum pump impeller has an average surface roughness of about 50 microns or less.

9. A self-priming pump assembly, comprising:

a motor having a motor housing;

a main pump having a main pump impeller, the main pump having a first side facing toward the motor and a second opposite side facing away from the motor, the main pump having a main pump inlet fluidly coupled to a priming tank, and a main pump outlet, the main pump for pumping a pumped fluid from the main pump inlet to the main pump outlet;

a drive shaft having a rotation axis, the drive shaft extending between the motor and the main pump impeller, the drive shaft directly driving the main pump impeller from the motor; and a vacuum pump having a vacuum pump impeller rotatably disposed in a vacuum pump housing along a rotation axis, the vacuum pump positioned adjacent the second opposite side of the main pump, and the vacuum pump impeller being coupled to the drive shaft and rotating about the rotation axis of the drive shaft, the vacuum pump is external to but fluidly coupled to the priming tank and provides a suction to the priming tank to self-prime the main pump; and a first bearing supporting the drive shaft adjacent the first side of the main pump;

a second bearing supporting the drive shaft adjacent the second opposite side of the main pump a first seal physically engaging and providing a seal about the drive shaft, the first seal positioned adjacent the first side of the main pump;

a first seal chamber holding a liquid bath to lubricate the first seal;

a second seal physically engaging and providing a seal about the drive shaft, the second seal positioned adjacent the second opposite side of the main pump;

a second seal chamber holding a liquid bath to lubricate the second seal; and a third seal physically engaging and providing a seal about the drive shaft, the third seal positioned adjacent the vacuum pump; and a third seal chamber holding a liquid bath to lubricate the third seal.

10. The self-priming pump assembly of claim 9, wherein the vacuum pump has a vacuum pump inlet and a vacuum pump outlet, wherein the vacuum pump inlet is in fluid communication with the priming tank.

11. The self-priming pump assembly of claim 10, further comprising a separator tank in thermal communication with a fluid being pumped by the main pump, the vacuum pump outlet in fluid communication with the separator tank.

12. The self-priming pump assembly of claim 9, wherein the vacuum pump impeller has an average surface roughness of about 100 microns or less.

13. The self-priming pump assembly of claim 9, wherein the vacuum pump impeller has an average surface roughness of about 50 microns or less.

14. A self-priming pump assembly, comprising:

a main pump having a main pump impeller;

a vacuum pump having a vacuum pump impeller;

a drive shaft configured to be driven about a rotation axis;

wherein the main pump impeller and the vacuum pump impeller are directly coupled to and driven by the drive shaft and rotate about the rotation axis of the drive shaft; and a first bearing supporting the drive shaft adjacent a first side of the vacuum pump impeller;

a second bearing supporting the drive shaft adjacent a second opposite side of the vacuum pump impeller;

a first seal housing having a first seal about the drive shaft, the first seal housing positioned adjacent the first side of the vacuum pump impeller and having a liquid oil bath to lubricate the first seal;

a second seal housing having a second seal about the drive shaft, the second seal housing positioned adjacent the second side of the vacuum pump impeller and having a liquid oil bath to lubricate the second seal; and a third seal housing having a third seal about the drive shaft, the third seal housing positioned between the main pump impeller and the vacuum pump and having a liquid oil bath to lubricate the third seal.

15. The self-priming pump assembly of claim 14, wherein the drive shaft is driven by a motor about a rotation axis, and wherein the main pump impeller and the vacuum pump impeller rotate about the rotation axis of the drive shaft.

16. The self-priming pump assembly of claim 15, wherein the drive shaft extends through a central aperture of the vacuum pump impeller from the first side of the vacuum pump impeller to the second side of the vacuum pump impeller.

17. A self-priming pump assembly comprising:

a motor having a motor housing;

a main pump having a main pump impeller;

a drive shaft having a rotation axis, the drive shaft extending between the motor and the main pump impeller, the drive shaft directly driving the main pump impeller from the motor;

a vacuum pump, separate from the main pump, having a vacuum pump impeller rotatably disposed in a vacuum pump housing along a rotation axis, the vacuum pump impeller situated between the main pump and the motor, and the vacuum pump impeller being coupled to the drive shaft and rotating about the rotation axis of the drive shaft;

a first bearing supporting the drive shaft between the motor and the vacuum pump impeller;

a second bearing supporting the drive shaft between the vacuum pump impeller and the main pump impeller;

a first seal housing having a first seal about the drive shaft, the first seal housing positioned adjacent a first side of the vacuum pump impeller and having a liquid oil bath to lubricate the first seal; and a second seal housing having a second seal about the drive shaft, the second seal housing positioned adjacent a second side of the vacuum pump impeller opposite the first side and having a liquid oil bath to lubricate the second seal;

a third bearing supporting the drive shaft between the second bearing and the main pump impeller; and a third seal housing having a third seal about the drive shaft, the third seal housing positioned between the main pump impeller and the vacuum pump.

18. The self-priming pump assembly of claim 17, wherein the third seal housing has a liquid oil bath to lubricate the third seal.

* * * * *